United States Patent [19]

Overton

[11] 4,119,821

[45] Oct. 10, 1978

[54] NORMALLY CLOSED SWITCH

[75] Inventor: Arthur Wayne Overton, Raleigh, N.C.

[73] Assignee: Stackpole Components Company, Raleigh, N.C.

[21] Appl. No.: 836,312

[22] Filed: Sep. 26, 1977

[51] Int. Cl.[2] ..... H01H 13/52

[52] U.S. Cl. ..... 200/159 R

[58] Field of Search ..... 200/159 R, 159 A, 243, 200/276

[56] References Cited

U.S. PATENT DOCUMENTS

| | | | |
|---|---|---|---|
| 3,767,878 | 10/1973 | Sykora | 200/276 X |
| 3,924,089 | 12/1975 | Abernethy | 200/159 R |
| 4,046,982 | 9/1977 | Schadow | 200/159 R |

*Primary Examiner*—Donald F. Norton

*Attorney, Agent, or Firm*—Brown, Flick & Peckham

[57] ABSTRACT

A switch case has a top provided with a central opening in which slides the stem of a plunger that has a foot inside the case. A bridging contact spring has a central portion engaging the foot and has free end portions extending away from opposite sides of the foot to form movable contacts normally engaging stationary electric contacts in the case beneath the movable contacts. Between each stationary contact and the central portion of the spring there is a fulcrum member beneath a movable contact so that when the central portion of the spring is moved downwardly by depressing the plunger, the movable contacts will rock on the fulcrum members and lift away from the stationary contacts.

1 Claim, 4 Drawing Figures

NORMALLY CLOSED SWITCH

This invention relates to switches that are especially suitable for keyboard switches used in calculators, data processing and stock quotation equipment, cash registers, audio-visual education equipment, communication equipment, typewriters and other devices. Similar switches are shown in U.S. Pat. Nos. 3,767,878 and 3,924,089, but in each of those patents the switch is normally held upen by a spring and is closed by depressing its plunger.

It is among the objects of this invention to provide a switch of the type shown in the above-mentioned patents, which is normally closed but can be opened by depressing its plunger, and which requires only one spring in its construction.

The preferred embodiment of the invention is illustrated in the accompanying drawings, in which.

Figure 1:
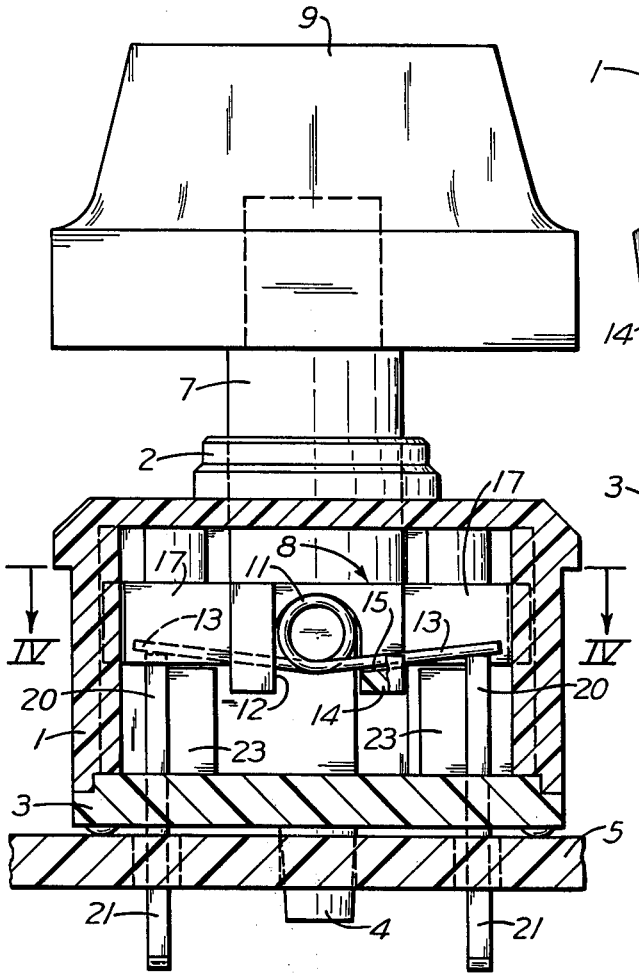
FIG. 1 is a vertical section of the closed switch.
Figure 2:
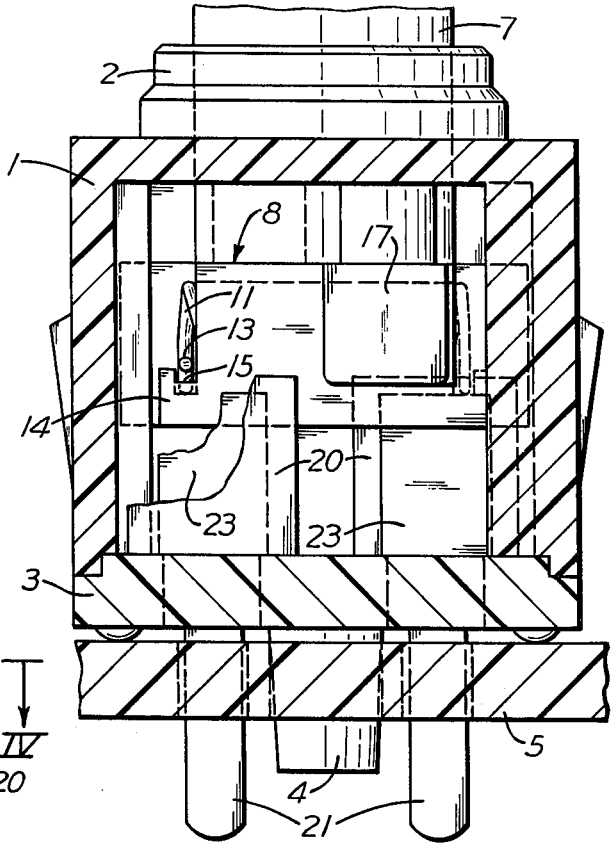
FIG. 2 is an enlarged fragmentary view at 90° to FIG. 1, with the near side of the switch case removed.
Figure 3:
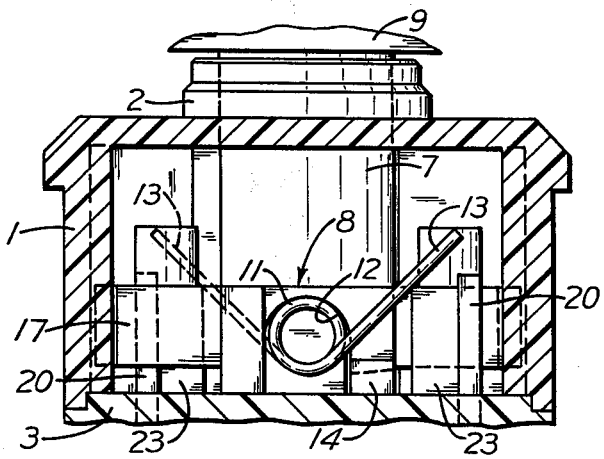
FIG. 3 is a fragmentary vertical section similar to FIG. 1, but with the switch open.
Figure 4:
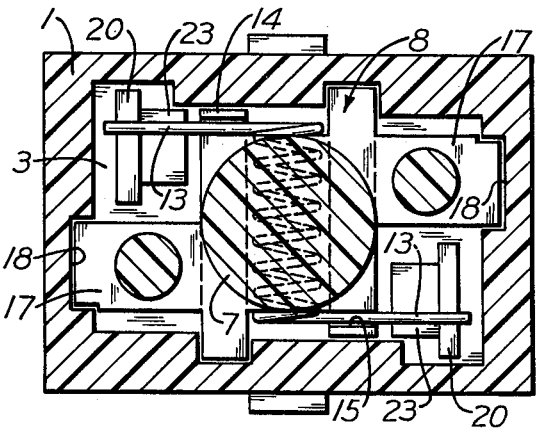
FIG. 4 is a horizontal section taken on the line IV-IV of FIG. 1.

Referring to FIGS. 1, 2 and 4 of the drawings, a rectangular case 1, generally molded from a plastic, has in its top wall a central vertical opening, around which a cylindrical flange 2 extends upwardly a short distance. The bottom wall 3 of the case is rigidly attached to the rest of the case in any suitable manner and is provided with a central vertical post 4 designed to have a press fit in a printed circuit board or other panel 5 on which the switch can be mounted. The post holds the switch in place.

The stem of a plunger 7 is slidably mounted in the top wall opening and flange 2 of the case and extends above the flange. The lower end of the stem inside the case is provided with a foot 8 that normally is held against the top wall of the case in a manner to be described presently. A push button or cap 9 can be mounted on the upper end of the plunger for depressing it.

The foot of the plunger carries a bridging contact inside the case. The bridging contact is formed from a spring that preferably includes a wire coil 11 extending across the plunger foot as shown in FIG. 4. The coil is disposed in a downwardly opening transverse slot 12 in the bottom of the foot. The opposite end portions of the coil wire are more or less straight and extend tangentially away from opposite sides of the bottom of the coil and also away from opposite sides of the plunger foot to form the movable contacts 13 of the switch extending towards the opposite ends of the case, as shown in FIG. 1. To hold the coil in place during assembly, these movable contacts press downwardly against slotted stops 14 formed by extending beneath the contacts two diagonally opposite lower corners of the side walls of slot 12. The stops are provided with shallow upwardly opening notches 15 that receive the wire forming the bridging contact member.

To help guide the foot of the plunger in the case so as to prevent it from turning, the foot preferably is provided with guide lugs 17 extending away from the opposite side walls of slot 12 in substantially parallel spaced relation with the straight end portions of the coil wire, as shown in FIG. 4. These guide lugs project beyond the ends of the wire and into sliding engagement with the end walls of the case. Preferably, the end walls are provided with guide slots 18 extending vertically across them for receiving the ends of the lugs. Also, it is preferred that the lugs be located at diagonally opposite corners of the foot of the plunger.

The inside of the case is provied with a pair of fixed or stationary electric contacts 20 directly beneath the movable contacts. Most conveniently, the stationary contacts project upwardly from the bottom wall of the case. Also, it is preferred to make these stationary contacts integral with terminals 21 that project from the bottom of the case. Thus, each stationary contact can be the exposed wide head of a narrow terminal that extends down through an opening in the bottom wall of the case.

It is a feature of this invention that the stationary contacts extend for enough up into the case to engage the movable contacts when the plunger is in its uppermost position, as shown in FIG. 1. The movable contacts, pressing down on the stationary contacts, cause the bridging contact member to support the plunger in its uppermost position in the case, so no other spring is required for urging the plunger upwardly. Since the stationary contacts are engaged by the bridging contact member while the plunger is up, it follows that the switch normally is closed.

To provide for opening the switch when the plunger is depressed, a fulcrum member 23 is disposed between each stationary contact and the wire coil in the plunger slot. These fulcrum members are located directly beneath the movable contacts, preferably close to the stationary contacts. While the switch is closed, the movable contacts are spaced a short distance above the fulcrum members, so there is no change that those members will interfere with proper engagement of the movable and stationary contacts. The fulcrum members can be formed conveniently from a plastic joined to the bottom wall of the case.

OPERATION

When the plunger is depressed, it moves the wire coil downwardly between the stationary contacts. The descending coil first pulls the movable contacts down against the fulcrum members and then causes the movable contacts to tilt or rock on them, thereby causing the outer ends of contacts 13 to lift away from the stationary contacts and open the switch. The moment the plunger is released, the tension on the bridging contact spring will cause it to lift the plunger until its foot engages the top wall of the case, at which time the movable contacts will once again be in engagement with the stationary contacts and the switch will be closed.

According to the provisions of the patent statutes, I have explained the principle of my invention and have illustrated and described what I now consider to represent its best embodiment. However, I desire to have it understood that, within the scope of the appended claims, the invention may be practiced otherwise than as specifically illustrated and described.

I claim:

1. A normally closed switch comprising a case having a top with an opening therethrough; a plunger having a foot in the case and a stem extending upwardly through said opening and above the case, a bridging contact member in the case at the lower end of the plunger, said contact member being formed from a spring having a central portion engaging said foot and having free end portions extending away from opposite sides of the foot to form movable contacts, a pair of stationary electric contacts mounted in the case beneath said movable contacts and normally engaged thereby, terminals connected with the stationary contacts and extending out of the case, and a fulcrum member in the case between each stationary contact and said central portion of the spring, said fulcrum members being disposed beneath said movable contacts and normally out of contact with them, the tops of the fulcrum members being lower than the tops of said stationary contacts, and the fulcrum members being of such height that when said central portion of the spring is moved downwardly by depressing the plunger said movable contacts will engage and rock on the fulcrum members and lift away from the stationary contacts to open the switch.

* * * * *